US007954459B2

(12) United States Patent
Ullman et al.

(10) Patent No.: US 7,954,459 B2
(45) Date of Patent: Jun. 7, 2011

(54) METHOD AND APPARATUS FOR VAPORIZING LIQUID

(75) Inventors: Alan Z. Ullman, Northridge, CA (US); Albert D. Tomassian, West Hills, CA (US); Brian L. Wherley, Chatsworth, CA (US); Clyde D. Newman, Oak Park, CA (US)

(73) Assignee: The Boeing Company, Chicago, IL (US)

( * ) Notice: Subject to any disclaimer, the term of this patent is extended or adjusted under 35 U.S.C. 154(b) by 664 days.

(21) Appl. No.: 11/769,385

(22) Filed: Jun. 27, 2007

(65) Prior Publication Data

US 2009/0000572 A1 Jan. 1, 2009

(51) Int. Cl.
*F22B 1/02* (2006.01)

(52) U.S. Cl. ..... 122/31.2; 122/31.1; 122/28; 122/367.1

(58) Field of Classification Search ..... 122/17.1, 122/21, 28, 31.1, 32, 161, 367.1–367.4, 31.2; 126/350.2; 165/104.16, 108, 185; 392/451
See application file for complete search history.

(56) References Cited

U.S. PATENT DOCUMENTS 1,019,164 A * 3/1912 Krohn et al. ..... 60/39.56
2,660,996 A * 12/1953 Wasp et al. ..... 126/109
3,465,123 A * 9/1969 Harris ..... 392/454
4,398,594 A * 8/1983 Klaren ..... 165/104.16
4,947,983 A * 8/1990 Jost ..... 202/163
5,355,456 A 10/1994 Osofsky
5,542,022 A 7/1996 Zauderer
5,816,496 A * 10/1998 Kovacs ..... 237/78 R
6,350,928 B1 * 2/2002 Waycuilis et al. ..... 585/15
7,281,498 B2 * 10/2007 Besik ..... 122/367.3
2002/0182128 A1 * 12/2002 Carnahan et al. ..... 422/188

OTHER PUBLICATIONS

R.H. Perry, D.W. Green, Heat Transfer Equipment, *Perry's Chemical Engineers' Handbook* (*7th Edition*), Section 11,<http://www.knovel.com/portal> (visited Feb. 20, 2009), Section 11, Copyright 1997 McGraw Hill.

KetemaLP, brochure, Form CV-3, Mar. 1998.

Water Treatment Systems for Power Plants—Steam Heated Vaporizer System, *IEC Fabchem Limited*,<http://www.chlorinator.In/F28432/steam_heated_vaporizer_system.html>(visited Feb. 12, 2009).

* cited by examiner

*Primary Examiner* — Gregory A Wilson
(74) *Attorney, Agent, or Firm* — Alston & Bird LLP

(57) ABSTRACT

An apparatus and method for vaporizing liquid are provided which employ a plurality of rods disposed within a storage vessel that serve as the heat transfer element. While the plurality of rods are generally submerged by the liquid fuel to facilitate heat transfer and vaporization of the liquid fuel, the rods may be packed closely together such that the liquid inventory required to maintain the rods in a submerged state is substantially less than required by conventional fuel supply systems, thereby permitting the weight of a fuel supply system that incorporates the apparatus and method to be reduced while still permitting effective vaporization of the fuel.

17 Claims, 4 Drawing Sheets

METHOD AND APPARATUS FOR VAPORIZING LIQUID

FIELD OF THE INVENTION

Embodiments of the of the present invention relate generally to an apparatus and method for vaporizing liquid and, more particularly, to an apparatus and method for vaporizing liquid that utilize a plurality of rods as heat transfer elements in order to reduce the liquid inventory required for heat transfer purposes.

BACKGROUND OF THE INVENTION

Chemical lasers require a gaseous fuel supply in which the fuel is provided in a vaporized form. It is also generally advisable that the fuel supply system associated with a chemical laser be relatively light. In order to reduce the weight of the fuel supply system, the fuel is therefore generally stored as a liquid. Since the fuel is stored as a liquid, the fuel supply system must be capable of providing the heat required for vaporization of the liquid in real time, that is, as the chemical laser is activated and requires a supply of gaseous fuel. The chemical laser operates for very brief periods, during which time the fuel heat of vaporization must be provided at a high rate. The time between laser operations can be much longer; during this period the thermal energy required for a subsequent laser operation can be accumulated at a much lower rate.

In order to vaporize the fuel in real time, the fuel supply system includes heat transfer elements that are submerged within a generally substantial volume of liquid fuel. Prior to activation of the chemical laser, the heat transfer elements are heated so as to store the energy to be subsequently used to vaporize some of the fuel that has been delivered to the chemical laser. In order to vaporize the fuel effectively, however, the heat transfer elements must generally remain submerged within the liquid fuel with the volume of the liquid fuel required to submerge the heat transfer elements generally comprising a significant portion of the total fluid inventory and, as such, the weight of the system. Further, the heat transfer elements must contain sufficient heat and have sufficient surface area to provide the fuel heat of vaporization for the desired time, at the desired rate and at the desired conditions of temperature and pressure.

One typical type of heat transfer element for fuel supply systems associated with chemical lasers are pebble bed heaters in which a bed of balls serve as the heat transfer elements and, accordingly, provide the thermal mass for the liquid vaporization. In a pebble bed heater, the minimum volume of liquid fuel that is required to submerge the balls in order to provide adequate heat transfer from the balls to the liquid for vaporization purposes is generally at least about 35% of the aggregate volume of the balls. As such, the liquid that is normally required to submerge the balls can create a potentially large fluid inventory which, in turn, adds to the weight of the fuel supply system. While the liquid required to submerge the balls or other heat transfer elements may substantially add to the weight of the fuel supply system, this volume of the liquid is generally not used as fuel for the laser since the balls must remain submerged within the liquid in order to provide effective heat transfer from the balls to the vaporizing liquid.

Accordingly, it would be desirable for a fuel supply system, such as the fuel supply system associated with a chemical laser, to provide sufficient heat storage and delivery rate for the vaporization process while reducing the weight of the fuel supply system, such as by reducing the liquid inventory required for heat transfer purposes.

SUMMARY

An apparatus and method for vaporizing liquid are therefore provided which address at least some of the shortcomings of conventional fuel supply systems and which provide still other advantages. In this regard, the method and apparatus for vaporizing liquid employ a plurality of rods disposed within a storage vessel that serve as the heat transfer element. While the plurality of rods are generally submerged by the liquid fuel to facilitate heat transfer and vaporization of the liquid fuel, the rods may be packed closely together such that the liquid inventory required to maintain the rods in a submerged state is substantially less than required by conventional fuel supply systems, thereby permitting the weight of a fuel supply system that incorporates the apparatus and method of one embodiment of the present invention to be reduced while still permitting effective vaporization of the fuel.

In one aspect of the present invention, an apparatus for vaporizing liquid is provided that includes a storage vessel in which the plurality of rods are disposed. In one embodiment, the plurality of rods may be cylindrical. The apparatus of this aspect of the present invention also includes a downcomer, disposed within the storage vessel and extending through the plurality of rods. The downcomer defines a passage to enable liquid to flow therethrough. In one embodiment, the plurality of rods and the downcomer are substantially parallel to one another. The apparatus of this aspect of the present invention also includes a liquid distributor disposed within the storage vessel and in fluid communication with the downcomer, for receiving the liquid that flows through the downcomer, for distributing the liquid amongst the plurality of rods. In one embodiment, for example, the liquid distributor may be porous. The downcomer generally extends between opposed first and seconds ends with the second end being in communication with the liquid distributor and the first end extending to a position that is equal with or that extends beyond the plurality of rods to facilitate the flow of liquid therethrough. The apparatus may also include a heater for heating the plurality of rods.

In accordance with another aspect of the present invention, an apparatus for vaporizing liquid is provided that includes the storage vessel, a plurality of rods, such as a plurality of cylindrical rods, and one or more downcomers extending through the plurality of rods and defining a passage to enable liquid to flow therethrough. In accordance with this aspect in the present invention, the plurality of rods and the downcomers are positioned so to be substantially parallel to one another within the storage vessel. In addition to being parallel, the downcomers may extend to a position that is equal with or that extends beyond the plurality of rods to facilitate the flow of liquid therethrough. The apparatus also includes a heater for heating the plurality of rods.

Further, the apparatus may include a liquid distributor disposed within the storage vessel. The liquid distributor is in communication with the downcomers for receiving a liquid that has flowed therethrough and is configured to distribute the liquid amongst the plurality of rods. For example, the liquid distributor may be porous to facilitate the distribution of liquid amongst the rods.

In accordance with a method of one embodiment of the present invention, the plurality of rods are at least partially immersed and, in one embodiment, are fully immersed within a liquid in a storage vessel. The plurality of rods are then heated to vaporize at least a portion of the liquid. Further, the liquid in which the plurality of rods are immersed is replenished to at least partially replace the liquid that is vaporized. In order to replenish the liquid, the liquid may be permitted to flow first through a downcomer that extends through the plurality of rods, then laterally through the distributor located in the storage vessel, and then upwards through the spaces between the plurality of rods.

In accordance with embodiments of the present invention, an apparatus and method are provided for vaporizing liquid in such a way that the plurality of rods that serve as the heat transfer elements may be submerged within a liquid so as to facilitate heat transfer and vaporization of the liquid in such a manner that the quantity of liquid required to submerge the rod is reduced relative to conventional designs. In one embodiment, the plurality of rods are disposed such that the liquid in which the rods are immersed is no more than 10% by volume of the rods. Accordingly, the liquid inventory that is required to submerge the rods and to provide for effective heat transfer is reduced and, in turn, the weight of the fuel supply system is advantageously reduced.

BRIEF DESCRIPTION OF THE DRAWINGS

Figure 1:
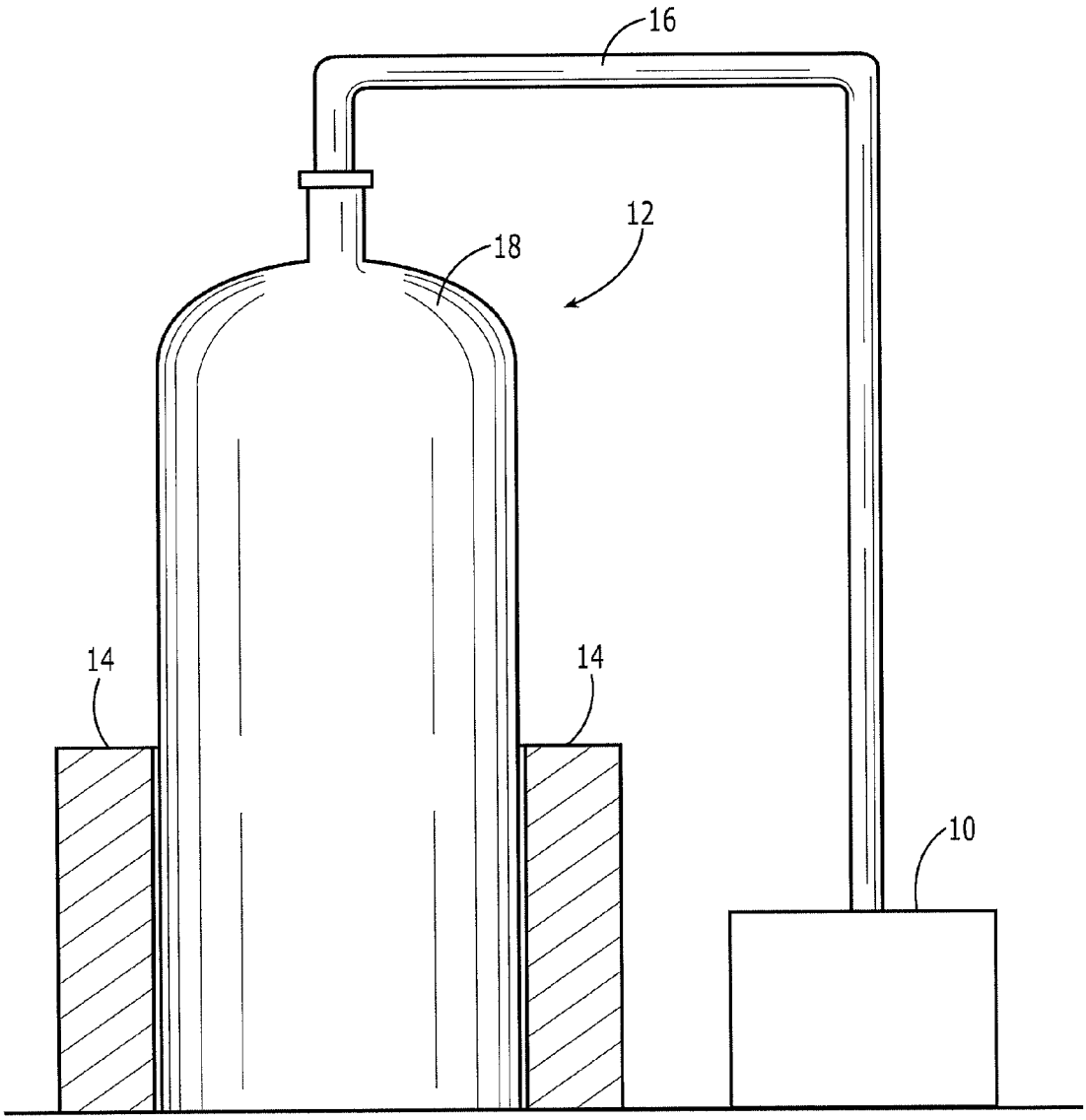
Figure 2:
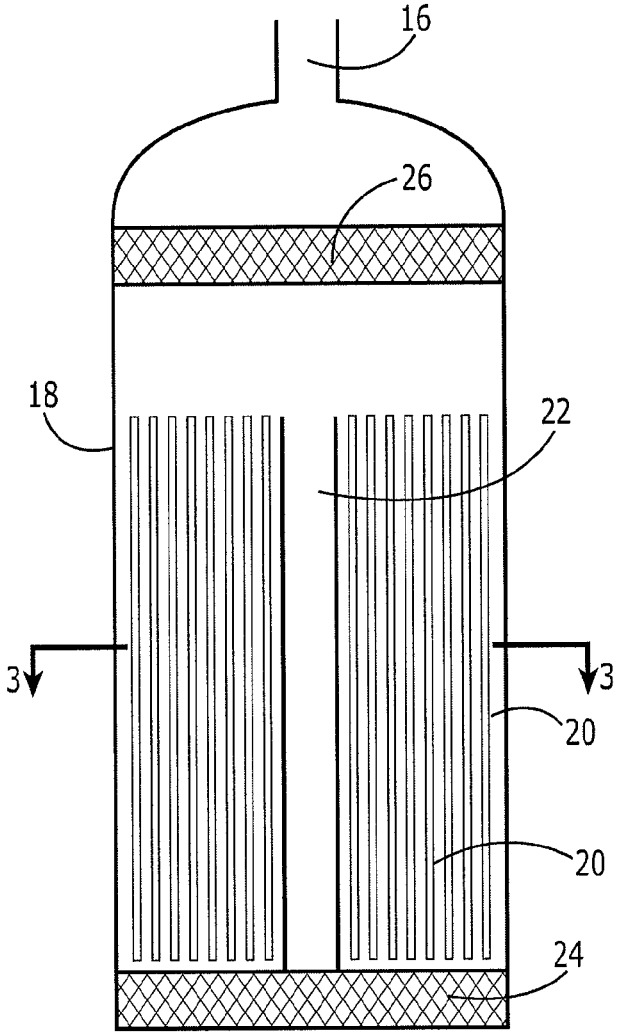
Figure 3:
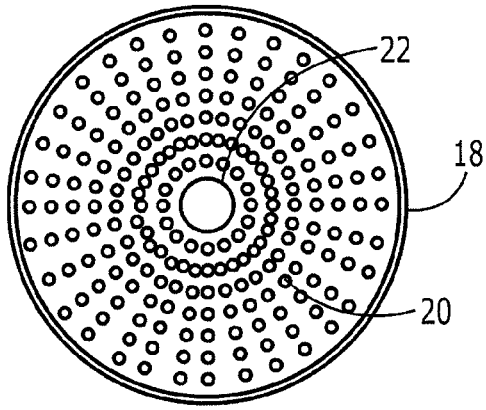
Figure 4:
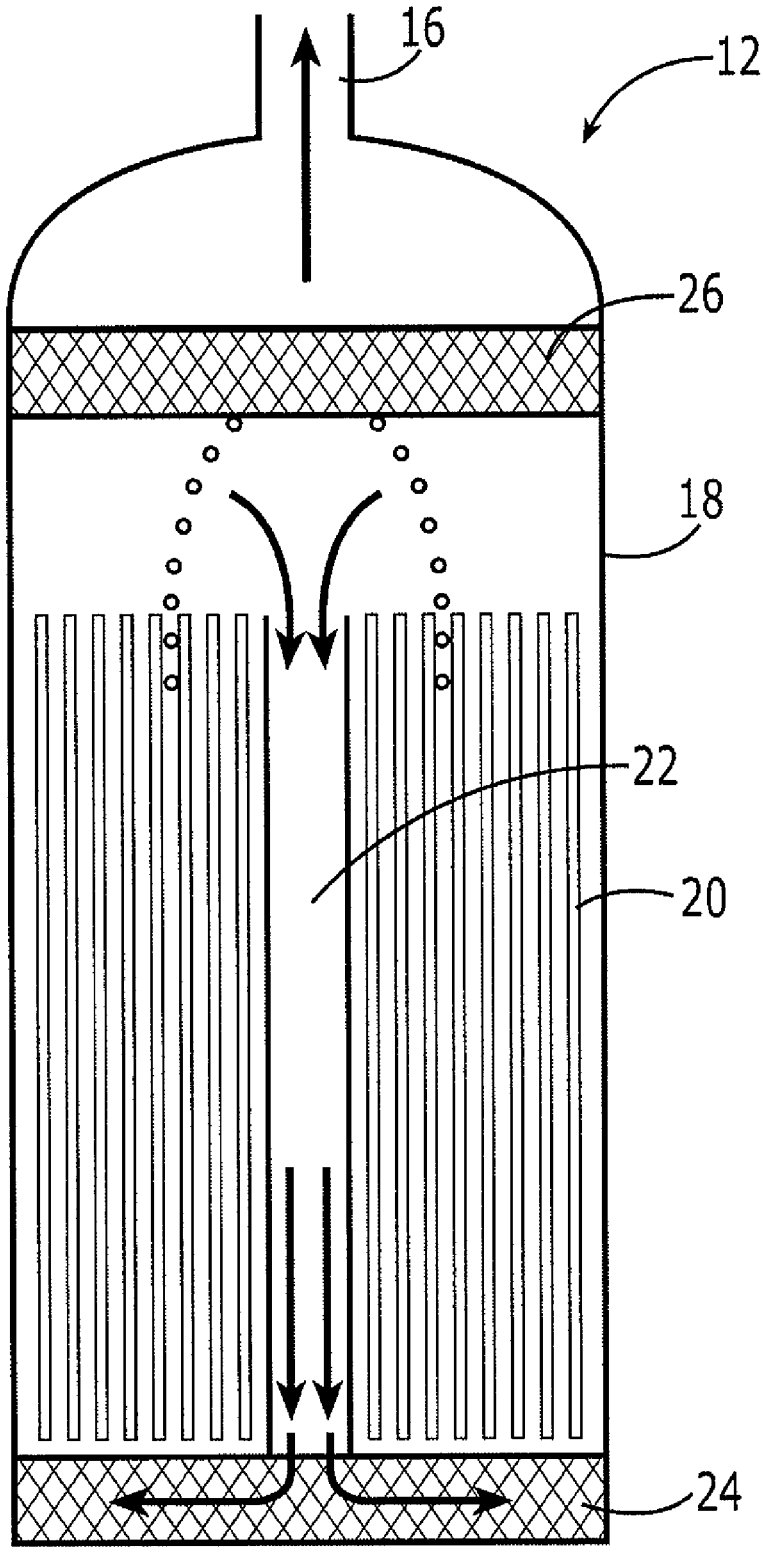
Figure 5:
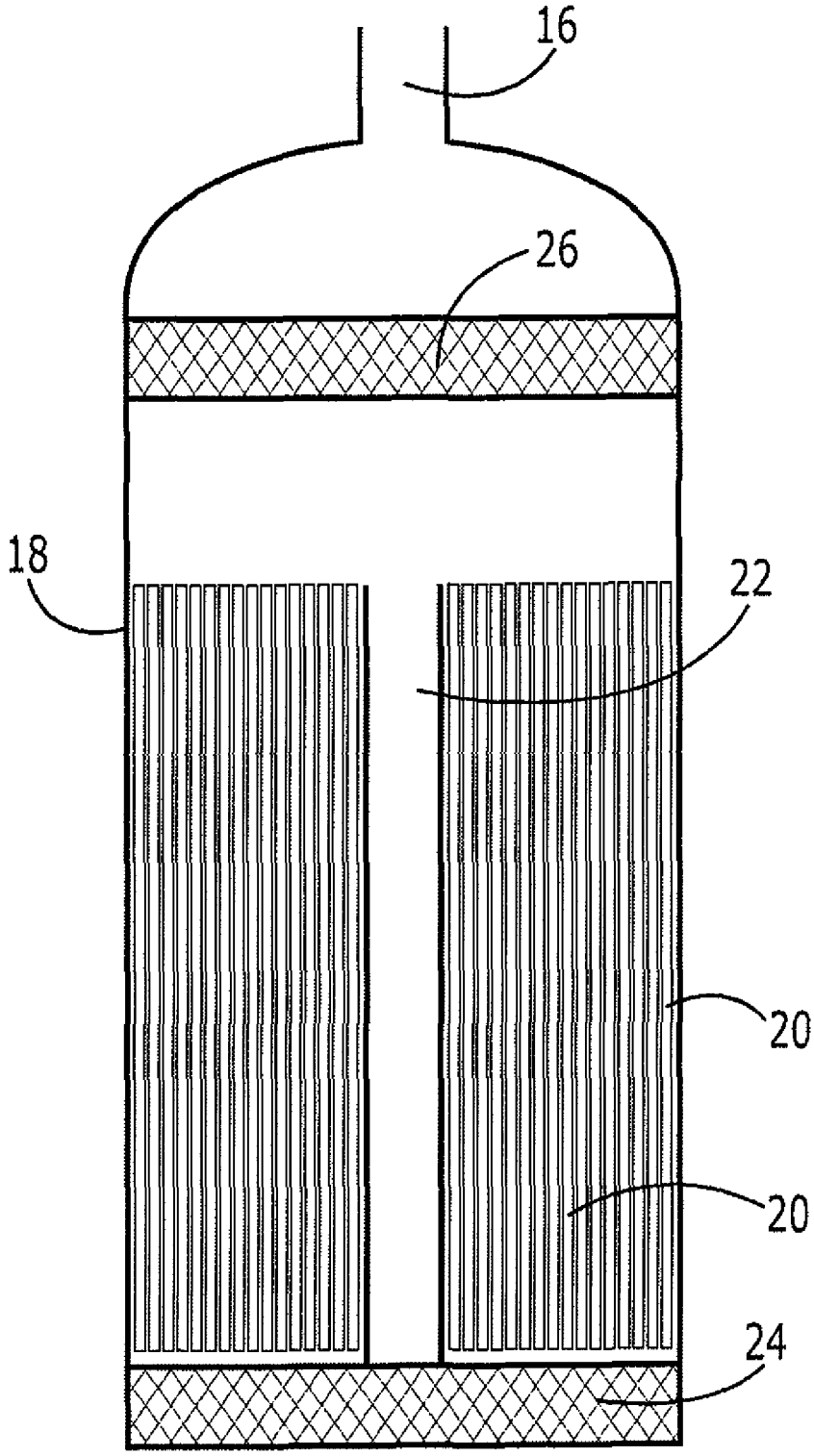

Having thus described the invention in general terms, reference will now be made to the accompanying drawings, which are not necessarily drawn to scale, and wherein:

FIG. 1 is a schematic representation of a fuel supply system and an associated chemical laser;

FIG. 2 is a cross-sectional side view of an apparatus in accordance with one embodiment of the present invention;

FIG. 3 is a cross-sectional view of the apparatus of FIG. 2 taken along line 3-3;

FIG. 4 is a simplified schematic representation of the flow of liquid and vapor within the apparatus of one embodiment of the present invention; and FIG. 5 is a cross-sectional side view of an apparatus in accordance with another embodiment of the present disclosure.

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, a chemical laser 10 and an associated fuel supply system 12 are depicted. A chemical laser may be embodied in a variety of different manners, including, for example, as a chemical oxygen-iodine laser. A chemical laser typically requires a supply of gaseous fuel. A fuel supply system can provide a variety of different types of fuel, such as chlorine in one embodiment. In order to reduce the overall weight of the fuel supply system, however, the fuel is generally stored in liquid form.

In order to provide gaseous fuel to the chemical laser 10 while storing the fuel in a liquid form, the fuel supply system 12 must heat the liquid in order to vaporize the liquid substantially in real time in response to activation of the chemical laser. As such, the fuel supply system generally includes a heater 14 for heating the liquid fuel. As described below, the heater generally does not directly heat the liquid fuel to the point of vaporization but, instead, heats one or more heat transfer elements which, in turn, heat the liquid fuel. The heater may be an external heater disposed about a storage vessel of the fuel supply system as shown in FIG. 1. Alternatively, the heater may be internal within the storage vessel of the fuel supply system in other embodiments that are described hereinbelow. Once heated, the vaporized fuel is provided to the chemical laser via one or more conduits 16 that connect the chemical laser and the storage vessel 18 of the fuel supply system thereby permitting operation of the chemical laser.

A fuel supply system 12 of one embodiment is depicted in FIGS. 2 and 3. As shown, the fuel supply system includes a storage vessel 18 that holds the liquid fuel. As such, the storage vessel is generally formed of a material, such as stainless steel, that is inert relative to the fuel. As noted above, the storage vessel includes one or more conduits 16 configured to interconnect the storage vessel and the chemical laser 10. In accordance with an embodiment to the present invention, the fuel supply system includes a plurality of rods 20 disposed within the storage vessel. As shown, the rods are generally elongate and may be packed so as to extend substantially parallel to one another. In one embodiment, the plurality of rods are positioned within a lower portion of the storage vessel, thereby generally filling the lower portion of the storage vessel. In the illustrated embodiment, for example, the plurality of rods extend from a first end proximate to the lower end of the storage vessel to an opposed second end in a medial portion of the storage vessel.

The elongate rods 20 may be cylindrical. However, the rods can have a plurality of other cross-sectional shapes, such as hexagonal, octagonal, rectangular or the like, and may have longitudinally non-uniform cross-sections such as to control the spacing between the rods and therefore the volume of liquid contained between the rods. The plurality of rods are also generally formed of a material that is inert with respect to the fuel stored within the storage vessel 18, while also having a relatively high heat capacity and being thermally conductive. In one embodiment, the plurality of rods are also formed of stainless steel. The plurality of rods therefore serve as the heat transfer elements in the fuel supply system 12 of the present invention. In order to facilitate heat transfer to the liquid, the plurality of rods, albeit generally packed quite closely, define some spaces therebetween so as to permit liquid to flow through the plurality of rods and to absorb heat therefrom, thereby vaporizing the liquid.

Since the plurality of rods 20 can be packed much more closely than the balls of a pebble bed heater, for example, the amount of liquid fuel required to submerge the plurality of rods is reduced, thereby similarly reducing the fluid inventory and, in turn, the overall weight of the fuel supply system 12. In one advantageous embodiment, the liquid required to submerge the plurality of rods has a volume that is 10% or less of the volume of the rods themselves. See, for example, FIG. 5.

Once heat has been transferred from a plurality of rods 20 to the liquid fuel, the fuel is vaporized and rises between the plurality of rods 20 and through the storage vessel 18 for collection and delivery to the chemical laser 10. In order to provide a continuous supply of gaseous fuel, the liquid that submerges and flows through the plurality of rods must also be continuously replenished. As such, the fuel supply system 12 also generally includes a downcomer 22 positioned within the storage vessel. The downcomer is an elongate tube that defines a lengthwise-extending passage through which liquid fuel flows. While, a cylindrical tube is depicted as the downcomer in the embodiment of FIGS. 2 and 3, the downcomer may also have other cross-sectional configurations, if so desired. Additionally, while the fuel supply system of FIGS. 1 and 2 is depicted to have a single downcomer, the fuel supply system of other embodiments may include two or more downcomers positioned throughout the densely-packed rods.

The downcomer 22 extends between opposed first and second ends. The first end is generally positioned proximate the lower portion of the storage vessel 18, while the opposed second end of the downcomer is positioned within a medial portion of the storage vessel and at an elevation that is either equal to (e.g., in the same plane as) or somewhat protruding beyond (e.g., above in the embodiment illustrated in FIG. 2) the plurality of rods 20 to facilitate the entry of liquid fuel into the downcomer. As with the plurality of rods, the downcomer must also be formed of a material that is inert with respect to the liquid fuel. As such, the downcomer, in one embodiment, is also formed of stainless steel.

The fuel that flows through the downcomer 22 is then advantageously distributed throughout the plurality of rods 20. As such, the fuel supply system 12 may also include a liquid distributor 24, e.g., a distribution manifold. In the illustrated embodiment, the liquid distributor is proximate to the lower portion of the storage vessel 18 and the first end of the downcomer is in fluid communication with the liquid distributor. As such, the liquid distributor receives the liquid flowing through the downcomer and disperses the liquid laterally through the storage vessel so as to supply liquid to flow around and among all of the rods. As with the plurality of rods and the downcomer, the liquid distributor is generally formed of the material that is inert with respect to the liquid fuel, such as stainless steel. In addition, the liquid distributor is generally porous as to facilitate the flow of liquid fuel there through. As such, in one embodiment, the liquid distributor is formed of one or more layers of stainless steel wire mesh.

Similarly, the fuel supply system 12 can include a disengager 26 that is generally positioned within an upper portion of the storage vessel 18. The disengager facilitates the separation of liquid from the vaporized gas prior to the communication of the vaporized fuel to the chemical laser 10. As with the liquid distributor 24, the disengager is generally formed of a material that is inert with respect to the fuel. Additionally, the disengager is generally somewhat porous to facilitate the propagation of vaporized fuel therethrough. As such, the disengager can also be formed of wire mesh, such as stainless steel mesh. As shown, the disengager is generally positioned within the storage vessel somewhat above the plurality of rods 20 and the downcomer 22 in order to define a liquid space within the storage vessel for holding liquid that will be subsequently utilized for evaporation. The disengager 26 may be positioned with a low side and a high side so as to allow liquid droplets in the vaporized gas and collected on the disengager 26 to drain back into the liquid contained in the vessel 18.

In order to provide gaseous fuel to the chemical laser 10, the plurality of rods 20 are heated. As such, the fuel supply system also generally includes a heater 14, such as an external heater depicted in FIG. 1. Alternatively, the heater can be internal within the storage vessel, such as embedded within the plurality of rods themselves in one embodiment. Additionally, it is noted that the rods may be heated in various manners, including electrically by passing current therethrough or by passing heated fluid through internal passageways defined by the rods. It is noted that the submergence of the plurality of rods within the liquid fuel serves to substantially equalize the heating throughout the plurality of rods, thereby avoiding or at least reducing temperature variations throughout the rods, since the liquid fuel serves as a heat carrier between the plurality of rods.

Once heated, the liquid fuel vaporizes and rises through the storage vessel 18, through the disengager 26 for delivery to the chemical laser 10. As shown in FIG. 4 in which the number of rods has been reduced and the spacing therebetween has been exaggerated for purposes of illustration, the rise of the bubbles of gas through the spaces between the plurality of rods 20 creates a slight pressure gradient that is generally sufficient to cause liquid fuel to flow downwardly through the downcomer 22 and then laterally outward through the liquid distributor 24 so as to re-supply liquid fuel within and between the plurality of rods. This flow of liquid fuel permits the vaporization process to be sustained with the cooling of the rods serving as the heat source for vaporization and the surface area of the rods serving to facilitate the heat transfer.

By providing a plurality of rods 20 that can be relatively densely packed within the storage vessel 18, the apparatus and method of embodiments of the present invention provide for the quick vaporization of the fuel while reducing the amount of liquid fuel required to submerge the heat transfer elements. As such, the liquid inventory may be reduced relative to that required by conventional fuel supply systems which, in turn, advantageously may reduce the weight of the fuel supply system 12.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for vaporizing liquid comprising:

a storage vessel;

a plurality of rods disposed within the storage vessel;

a heater for heating the plurality of rods so that the rods are configured to heat the liquid;

a downcomer disposed within the storage vessel and extending through the plurality of rods, the downcomer defining a passage to enable liquid to flow therethrough; and a liquid distributor disposed within the storage vessel in fluid communication with the downcomer for receiving the liquid that has flowed through the downcomer and for distributing the liquid amongst the plurality of rods.

2. An apparatus according to claim 1 wherein the plurality of rods and the downcomer are substantially parallel to one another.

3. An apparatus according to claim 1 wherein the plurality of rods are disposed such that the liquid in which the rods are immersed is no more than 10% by volume of the rods.

4. An apparatus according to claim 1 wherein the downcomer extends between opposed first and second ends with the second end being in communication with the liquid distributor and the first end extending to a position beyond the plurality of rods.

5. An apparatus according to claim 1 wherein the plurality of rods are cylindrical.

6. An apparatus according to claim 1 wherein the liquid distributor is porous.

7. An apparatus according to claim 1 further comprising a disengager disposed within the storage vessel and configured to facilitate separation of the liquid from vaporized gas prior to discharge from the storage vessel.

8. An apparatus for vaporizing liquid comprising:

a storage vessel;

a plurality of rods;

a heater for heating the plurality of rod so that the rods are configured to heat the liquid; and a downcomer extending through the plurality of rods, the downcomer defining a passage to enable liquid to flow therethrough;

a disengager disposed within the storage vessel and configured to facilitate separation of the liquid from vaporized gas prior to discharge from the storage vessel, wherein the plurality of rods and the downcomer are positioned so as to be substantially parallel to one another within the storage vessel.

9. An apparatus according to claim 8 wherein the plurality of rods are disposed such that the liquid in which the rods are immersed is no more than 10% by volume of the rods.

10. An apparatus according to claim 8 wherein the downcomer extends to a position that is equal with or that extends beyond the plurality of rods.

11. An apparatus according to claim 8 wherein the plurality of rods are cylindrical.

12. An apparatus according to claim 8 further comprising a liquid distributor disposed within the storage vessel in fluid communication with the downcomer for receiving the liquid that has flowed through the downcomer and for distributing the liquid amongst the plurality of rods.

13. An apparatus according to claim 12 wherein the liquid distributor is porous.

14. A method for vaporizing liquid comprising:

at least partially immersing a plurality of rods within the liquid in a storage vessel;

heating the plurality of rods to thereby vaporize at least a portion of the liquid; and replenishing the liquid in which the plurality of rods are immersed to at least partially replace the portion of the liquid that is vaporized, wherein replenishing the liquid comprises permitting the liquid to flow first through a downcomer that extends through the plurality of rods and then laterally through the storage vessel.

15. A method according to claim 14 wherein at least partially immersing the plurality of rods comprises fully immersing the plurality of rods within the liquid.

16. A method according to claim 15 wherein at fully immersing the plurality of rods comprises immersing the plurality of rods such that the liquid in which the rods are immersed is no more than 10% by volume of the rods.

17. A method according to claim 14 further comprising facilitating separation of the liquid from vaporized gas prior to discharge from the storage vessel.

* * * * *